US005979653A

United States Patent [19]

Owens et al.

[11] Patent Number: 5,979,653

[45] Date of Patent: Nov. 9, 1999

[54] PEEL MECHANISM FOR PEELABLE BARRIER FILM FOR VACUUM SKIN PACKAGES AND THE LIKE

[75] Inventors: Robin Dalton Owens, Greer; Robin Hill Logan, Moore; Henry Walker Stockley, III, Spartanburg, all of S.C.

[73] Assignee: Cryovac, Inc., Duncan, S.C.

[21] Appl. No.: 08/998,123

[22] Filed: Dec. 24, 1997

[51] Int. Cl.[6] ..... B65D 85/00; A23B 4/00; A23B 4/10

[52] U.S. Cl. ..... 206/484.1; 206/484.2; 426/123; 426/127; 426/129

[58] Field of Search ..... 53/133.3, 412; 426/123, 127, 129, 122; 206/484.1, 484.2

[56] References Cited

U.S. PATENT DOCUMENTS

| | | | |
|---|---|---|---|
| Re. 30,009 | 5/1979 | Perdue et al. | 53/433 |
| 2,268,474 | 12/1941 | Chalmers | 53/133.3 |
| 3,287,878 | 11/1966 | Mobley | 53/133.3 X |
| 3,373,926 | 3/1968 | Voigtman et al. | 53/133.3 |
| 3,471,351 | 10/1969 | Fuchs | 53/133.3 |
| 3,491,504 | 1/1970 | Young et al. | 53/22 |
| 3,574,642 | 4/1971 | Weinke | 99/174 |
| 3,681,092 | 8/1972 | Titchenal et al. | 99/174 |
| 3,713,849 | 1/1973 | Grindrod et al. | 99/174 |
| 4,055,671 | 10/1977 | Mahaffy et al. | 426/123 |
| 4,055,672 | 10/1977 | Hirsch et al. | 426/127 |
| 4,196,809 | 4/1980 | Tonrey | 206/534 |
| 4,285,430 | 8/1981 | Caunt | 206/471 |
| 4,287,151 | 9/1981 | Esakov et al. | 264/560 |
| 4,382,513 | 5/1983 | Schirmer et al. | 206/484 |
| 4,638,913 | 1/1987 | Howe, Jr. | 206/632 |
| 4,766,018 | 8/1988 | Hinrichsen et al. | 428/35 |
| 4,875,587 | 10/1989 | Lulham et al. | 206/484 |
| 4,886,690 | 12/1989 | Davis et al. | 428/36.6 |
| 4,889,731 | 12/1989 | Williams, Jr. | 426/106 |
| 4,952,628 | 8/1990 | Blatz | 525/58 |
| 4,956,212 | 9/1990 | Bekele | 428/36.6 |
| 4,977,004 | 12/1990 | Bettle, III et al. | 428/36.7 |
| 5,075,143 | 12/1991 | Bekele | 428/36.6 |
| 5,106,688 | 4/1992 | Bradfute et al. | 428/215 |
| 5,346,735 | 9/1994 | Logan et al. | 428/36.7 |

FOREIGN PATENT DOCUMENTS

| | | |
|---|---|---|
| 245774 | 2/1961 | Australia . |
| 0 226 921 | 12/1986 | European Pat. Off. . |
| 1258357 | 3/1961 | France . |
| 1286018 | 1/1962 | France . |
| 2240234 | 4/1973 | Germany . |

*Primary Examiner*—Linda Johnson
*Attorney, Agent, or Firm*—Leigh P. Gregory; Thomas C. Lagaly

[57] ABSTRACT

A composite film and vacuum skin package for packaging a product such as a fresh red meat is disclosed. The composite film is thermoformed and sealed under vacuum to a support member to completely enclose a product which is positioned on the support member. The composite film is a gas-permeable film weakly bonded to a gas-impermeable film, permitting the gas-impermeable film to be peeled from the package while leaving the gas-permeable film intact so that the fresh red meat product can bloom from a purplish color to a desirable red color upon exposure to oxygen. A peel initiation mechanism which is a grippable film sealed along an edge of the gas-impermeable film is provided.

8 Claims, 7 Drawing Sheets

PEEL MECHANISM FOR PEELABLE BARRIER FILM FOR VACUUM SKIN PACKAGES AND THE LIKE

BACKGROUND OF THE INVENTION

This invention generally relates to thermoformable barrier films and to vacuum skin packages which can be made therefrom. More particularly, the invention relates to vacuum skin packaging utilizing multilayer gas barrier films comprising a peelable gas-impermeable (i.e., barrier) film adhered to a gas-permeable film, and a peel mechanism for easily removing the gas-impermeable film from the gas-permeable film.

Skin packaging can be classified as a vacuum forming process for thermoformable polymeric films. The product on a supporting member serves as the mold for the thermoformable film which is formed about the product by means of differential air pressure. The term "vacuum skin packaging" (hereinafter "VSP") as used herein indicates that the product is packaged under vacuum and the space containing the product is evacuated from gases. It is therefore desirable that the film formed around the product and for the support member to each present a barrier to oxygen, air, and other gases detrimental to the shelf or storage life of a product such as a food product.

Skin packaging is described in many references, including French Patent No. 1,258,357, French Patent No. 1,286,018, Australian Patent No. 3,491,504, U.S. Pat. No. RE 30,009, U.S. Pat. No. 3,574,642, U.S. Pat. No. 3,681,092, U.S. Pat. No. 3,713,849, U.S. Pat. No. 4,055,672, U.S. Pat. No. 4,889,731, and U.S. Pat. No. 5,346,735. The disclosures of each of the foregoing references is hereby incorporated herein by reference. Typically, skin packaging provides just a barrier film that upon removal from the package leaves the product exposed to atmosphere, which is sufficient for applications such as bulk meat cutting and repackaging. It is desirable in other applications to provide a composite packaging film comprising both a gas-permeable (i.e., non-barrier) film and a peelable gas-impermeable film so that upon removal of the peelable gas-impermeable film the product is still selectively protected by the gas-permeable film. This permits a product such as a fresh red meat to be protected by the gas-permeable film but allows the meat to "bloom" from a purplish color to a customer-preferred reddish color upon exposure to oxygen.

One problem with all such peelable composite films is the difficulty of initiating the peel. Although, generally, the gas-impermeable film will peel easily from the gas-permeable film after initiation of the peel, actually beginning the peeling process can be difficult. Without some peel initiation mechanism in place, the person attempting to peel the gas-impermeable film from the gas-permeable film must flick at the package edge with his thumb or fingers and, often, packages are damaged when further measures become necessary. Thus, providing an acceptable peel initiation mechanism has become an important aspect of designing any package which employs a peelable composite film.

One example of a prior art peel initiation mechanism is set forth in U.S. Pat. No. 5,346,735, referenced above. During the process of making a vacuum skin package, a tab is placed on, but not adhered to, the lower support web, extending along one edge. When the upper composite film web is formed around the product contained on the lower web, it welds to the upper surface of the tab. When the tab is pulled, the gas-permeable film, which is more strongly bonded to the lower web than to the gas-impermeable film, ruptures at or near the tab and the gas-impermeable film is peeled therefrom. However, during the package forming process it is difficult to automate the precise placement of the tab and after peeling of the gas-impermeable film from the gas-permeable film the torn edge of the gas-permeable film is noticeable, detracting from the desired neat appearance of the package.

An alternative prior art peel initiation mechanism is disclosed in U.S. Pat. No. 4,889,731, also referenced above. A label having a non-sealable upper surface is adhered to the lower web, extending along one edge. When the upper composite film web is formed around the product contained on the lower web, it does not adhere to the upper surface of the label. A series of perforations are formed through the upper and lower webs adjacent to the label. When the upper web is pulled from the label the perforations provide a point of rupture for the gas-permeable film which is more strongly bonded to the lower web than to the gas-impermeable film, and the gas-impermeable film is peeled therefrom. However, as above, during the package forming process it is difficult to automate the precise placement of the label and after peeling of the gas-impermeable film from the gas-permeable film the torn edge of the gas-permeable film is noticeable, detracting from the desired neat appearance of the package.

It is therefore desirable to provide a peel mechanism for use with peelable composite packaging films without these disadvantages.

SUMMARY OF THE INVENTION

In one aspect the present invention is directed to a package which includes a support web, a product supported on the support web, a composite film enclosing the product, the composite film formed of a gas-permeable component film having an upper surface and a lower surface, the lower surface of the gas-permeable film welded to the support web and a gas-impermeable component film having an upper surface and a lower surface, the lower surface of the gas-impermeable film bonded to the upper surface of the gas-permeable film, wherein the bond strength between the gas-impermeable film and the gas-permeable film is less than the bond strength between the gas-permeable film and the support web, and a peel initiation mechanism which is a grippable film sealed to the upper surface of the gas-impermeable film forming a sealed area at and along an edge of the gas-impermeable film, a nonsealed portion of the grippable film extending from the sealed area, wherein the bond strength between the grippable film and the gas-impermeable film is greater than the bond strength between the gas-impermeable film and the gas-permeable film.

More specifically, the present invention is directed to a package which includes a support member, a composite film in adherence with the support member such that an enclosure suitable for containment of a product is formed, the composite film comprising a gas-permeable component film and a gas-impermeable component film which is peelably removable from the gas-permeable film, the gas-permeable film positioned between the gas-impermeable film and the support member and comprising a bonding layer that is peelably adhered to the gas-impermeable film, and a grippable film sealed to an upper surface of the gas-impermeable film along an edge of the gas-impermeable film, the grippable film having a grippable portion extending from the seal, wherein the bond strength between the gas-permeable film and the gas-impermeable film is less than seal strength between the grippable film and the gas-impermeable film, such that the gas-impermeable film may be peeled from the gas-permeable film by pulling the grippable film.

Furthermore, the present invention provides a method for making a plurality of packages which includes the steps of:

a) providing a gas-impermeable lower web having an upper surface having a plurality of product support areas defined thereon;

b) placing a product on each product support area of the lower web;

c) extending an upper composite film above the lower web and the products contained thereon, the upper composite film comprising:

1) a gas-permeable component film having an upper surface and a lower surface, the lower surface of the gas-permeable film being immediately above and directly opposed to the upper surface of the lower web; and 2) a gas-impermeable component film having an upper surface and a lower surface, the lower surface of the gas-impermeable film bonded to the upper surface of the gas-permeable film; and d) welding the lower surface of the gas-permeable film to the upper surface of the lower web at areas intermediate to the product support areas;

e) extending at least one grippable film above bonded areas of the composite film that are intermediate to the product support areas;

f) sealing a portion of the grippable film to the upper surface of the gas-impermeable film of the upper composite film such that a nonsealed portion of the grippable film extends from the sealed portion; and g) cutting the grippable film, the upper composite film and the lower web through the sealed portion of the grippable film.

DEFINITIONS

As used herein, the term "film" refers to a thermoplastic material, generally in sheet or web form, having one or more layers of polymeric or other materials which may be bonded together by any suitable means well known in the art, e.g., coextrusion, lamination, etc. A film can be a monolayer film (having only one layer), or a multilayer film (having two or more layers).

As used herein, the term "composite film" refers to a film having at least two layers which are bonded together by any suitable means well known in the art, e.g., coextrusion, lamination, etc. and which is separable into at least two component films.

As used herein, the term "component film" refers to a film which is a part of a composite film.

As used herein, the term "layer" refers to a discrete film component which is coextensive with the film and has a substantially uniform composition. In a monolayer film, the "film" and "layer" would be one and the same.

As used herein, the phrase "interior layer" refers to any layer of a multilayer film having both of its principal surfaces directly adhered to another layer of the film.

As used herein, the phrase "exterior layer" refers to any layer of a multilayer film having only one of its principal surfaces directly adhered to another layer of the film. In the multilayer films of the present invention, there are two exterior layers, each of which has a principal surface adhered to only one other layer of the multilayer film. The other principal surface of each of the two exterior layers form the two principal outer surfaces of the multilayer film.

As used herein, the phrase "sealant layer" refers to any exterior layer of a multilayer film which is sealable to another film or thermoplastic sheet.

As used herein, the phrase "bonding layer" refers to an interior layer of a composite film which bonds a component film of that composite film to another component film of that same composite film or an exterior layer of a film which bonds or is capable of bonding to another film or thermoplastic sheet.

"Lamination," "laminate," "laminated" and the like refer to a multiple-film or multiple-web composite structure having two or more films or webs that are bonded together by any suitable means, including adhesive bonding, reactive surface modification, heat treatment, pressure treatment, etc., including combinations thereof.

As used herein, the phrase "gas-permeable" refers to a film or web which admits at least about 1,000 cc of gas, such as oxygen, per square meter of film per 24 hour period at 1 atmosphere and at a temperature of 73° F. (at 0% relative humidity). More preferably, a gas-permeable film or web admits at least 5,000, even more preferably at least 8,000 such as at least 10,000, 15,000, 20,000, 25,000, 30,000, 35,000, 40,000, and 50,000, and most preferably at least 100,000 cc of oxygen per square meter per 24 hour period at 1 atmosphere and at a temperature of 73° F. (at 0% relative humidity). In accordance with the present invention, a gas-permeable film or web can itself have the aforedescribed levels of gas permeability or, alternatively, can be a film or web which does not inherently possess such levels of gas permeability but which is altered, e.g., perforated, to render the film or web gas-permeable as defined above.

As used herein, the phrase "gas-impermeable" refers to a film or web which is substantially gas-impermeable, i.e. one which admits less than 1000 cc of gas, such as oxygen, per square meter of film per 24 hour period at 1 atmosphere and at a temperature of 73° F. (at 0% relative humidity). More preferably, a substantially gas-impermeable film or web admits less than about 500, such as less than 300, and less than 100 cc of gas, more preferably still less than about 50 cc, and most preferably less than 25 cc, such as less than 20, less than 15, less than 10, less than 5, and less than 1 cc of gas per square meter per 24 hour period at 1 atmosphere and at a temperature of 73° F. (at 0% relative humidity).

As used herein, the terms "delaminate," "delaminating," and the like refer generally to the internal separation of a multilayer film within a layer and/or at an inter-layer (i.e., layer/layer) interface within the coextruded film when such film, or laminate of which the coextruded film is a component, is subjected to a delaminating force of sufficient magnitude. The internal separation preferably occurs at a pre-selected layer/layer interface, and/or within a pre-selected layer, such that the multilayer film delaminates into a gas-permeable portion and a gas-impermeable portion.

As used herein, the term "intra-film cohesive strength" refers to the internal force with which a film remains intact, as measured in a direction that is generally perpendicular to the plane of the film. In a multilayer film, intra-film cohesive strength is provided both by inter-layer adhesion (the adhesive strength between the layers which binds them to one another) and by the intra-layer cohesion of each film layer (i.e., the cohesive strength of each of the film layers). In a monolayer film, intra-film cohesive strength is provided only by the intra-layer cohesion of the layer which constitutes the film.

As used herein, the term "bond-strength" refers to the amount of force required to peelably separate two films or webs which are bonded together, e.g., laminated, in accordance with ASTM F904-91, and is reported in units of force/width of the laminated films.

As used herein, the term "tie layer" designates an adhesive layer in a film.

As used herein, the phrase "ethylene/alpha-olefin copolymer" generally designates copolymers of ethylene with one or more comonomers selected from $C_3$ to $C_{20}$ alpha-olefins, such as 1-butene, 1-pentene, 1-hexene, 1-octene, methyl pentene and the like, in which the polymer molecules comprise long chains with relatively few side chain branches. These polymers are obtained by low pressure polymerization processes and the side branching which is present will be short compared to non-linear polyethylenes (e.g., LDPE, a low density polyethylene homopolymer). Ethylene/alpha-olefin copolymers generally have a density in the range of from about 0.86 g/cc to about 0.94 g/cc. The term linear low density polyethylene (LLDPE) is generally understood to include that group of ethylene/alpha-olefin copolymers which fall into the density range of about 0.915 to about 0.94 g/cc. Sometimes linear polyethylene in the density range from about 0.926 to about 0.94 is referred to as linear medium density polyethylene (LMDPE). Lower density ethylene/alpha-olefin copolymers may be referred to as very low density polyethylene (VLDPE, typically used to refer to the ethylene/butene copolymers available from Union Carbide with a density ranging from about 0.88 to about 0.91 g/cc) and ultra-low density polyethylene (ULDPE, typically used to refer to the ethylene/octene copolymers supplied by Dow).

The phrase "ethylene/alpha-olefin copolymer" also includes homogeneous polymers such as metallocene-catalyzed EXACT™ linear homogeneous ethylene/alpha-olefin copolymer resins obtainable from the Exxon Chemical Company, of Baytown, Tex.; TAFMER™ linear homogeneous ethylene/alpha-olefin copolymer resins obtainable from the Mitsui Petrochemical Corporation; and long-chain branched, metallocene-catalyzed homogeneous ethylene/alpha-olefin copolymers available from The Dow Chemical Company, known as AFFINITY™ resins. The phrase "homogeneous polymer" refers to polymerization reaction products of relatively narrow molecular weight distribution and relatively narrow composition distribution. Homogeneous polymers are structurally different from heterogeneous polymers (e.g., ULDPE, VLDPE, LLDPE, and LMDPE) in that homogeneous polymers exhibit a relatively even sequencing of comonomers within a chain, a mirroring of sequence distribution in all chains, and a similarity of length of all chains, i.e., a narrower molecular weight distribution. Furthermore, homogeneous polymers are typically prepared using metallocene, or other single-site type catalysts, rather than using Ziegler-Natta catalysts. Such single-site catalysts typically have only one type of catalytic site, which is believed to be the basis for the homogeneity of the polymers resulting from the polymerization.

As used herein, the term "olefin" generally refers to any one of a class of monounsaturated, aliphatic hydrocarbons of the general formula $C_nH_{2n}$, such as ethylene, propylene, and butene. The term may also include aliphatics containing more than one double bond in the molecule such as a diolefin or diene, e.g., butadiene.

As used herein, the term "heat-seal" (also known as a "heat-weld") refers to the union of two films by bringing the films into contact, or at least close proximity, with one another and then applying sufficient heat and pressure to a predetermined area (or areas) of the films to cause the contacting surfaces of the films in the predetermined area to become molten and intermix with one another, thereby forming an essentially inseparable bond between the two films in the predetermined area when the heat and pressure are removed therefrom and the area is allowed to cool. In accordance with the practice of the present invention, a heat-seal preferably creates a hermetic seal, i.e., a barrier to the outside atmosphere.

As used herein, the term "PVDC" designates polyvinylidene chloride copolymers. Typical PVDC copolymers include vinylidene chloride/vinyl chloride copolymer, vinylidene chloride/methyl acrylate copolymer, and vinylidene chloride/acrylonitrile copolymer.

As used herein, the term "EVA" designates ethylene/vinyl acetate copolymer.

As used herein, the term "EMA" designates ethylene/methyl acrylate copolymer.

As used herein, the term "EBA" designates ethylene/butyl acrylate copolymer.

As used herein, the term "EPC" designates ethylene/propylene copolymer.

As used herein, the term "HDPE" designated high density polyethylene.

As used herein, the term "EVOH" designates ethylene/vinyl alcohol copolymer or hydrolyzed ethylene/vinyl acetate copolymer and is sometimes abbreviated "HEVA". EVOH resins are noted for their very good gas barrier properties but can be moisture sensitive. These resins are available from suppliers such as Evalca in the United States, and Kuraray and Nippon Gohsei in Japan.

As used herein, the term "Ionomer" designates metal salts of acidic copolymers, such as metal salts of ethylene/acrylic acid copolymers or metal salts of ethylene/methacrylic acid copolymers. These are available from DuPont under the trade name Surlyn™.

DETAILED DESCRIPTION OF THE INVENTION

The present invention is directed to a peel initiation mechanism for peelable composite films. Although it is preferred in accordance with the present invention that the peelable film is a vacuum skin packaging web which is the upper web in a vacuum skin package, it should be noted that the present inventive peel initiation mechanism may also be employed to initiate composite film delamination in other types of packages. For example, peelable films and laminates which are not formed to the underlying product are occasionally employed as lidding for tray-type packages. In addition, the peelable composite film may be used to construct the lower, support member or web where it is desired that the lower web is peelable in addition to or instead of the upper web being peelable. The present peel initiation mechanism is appropriate for use in all such packages.

Figure 1:
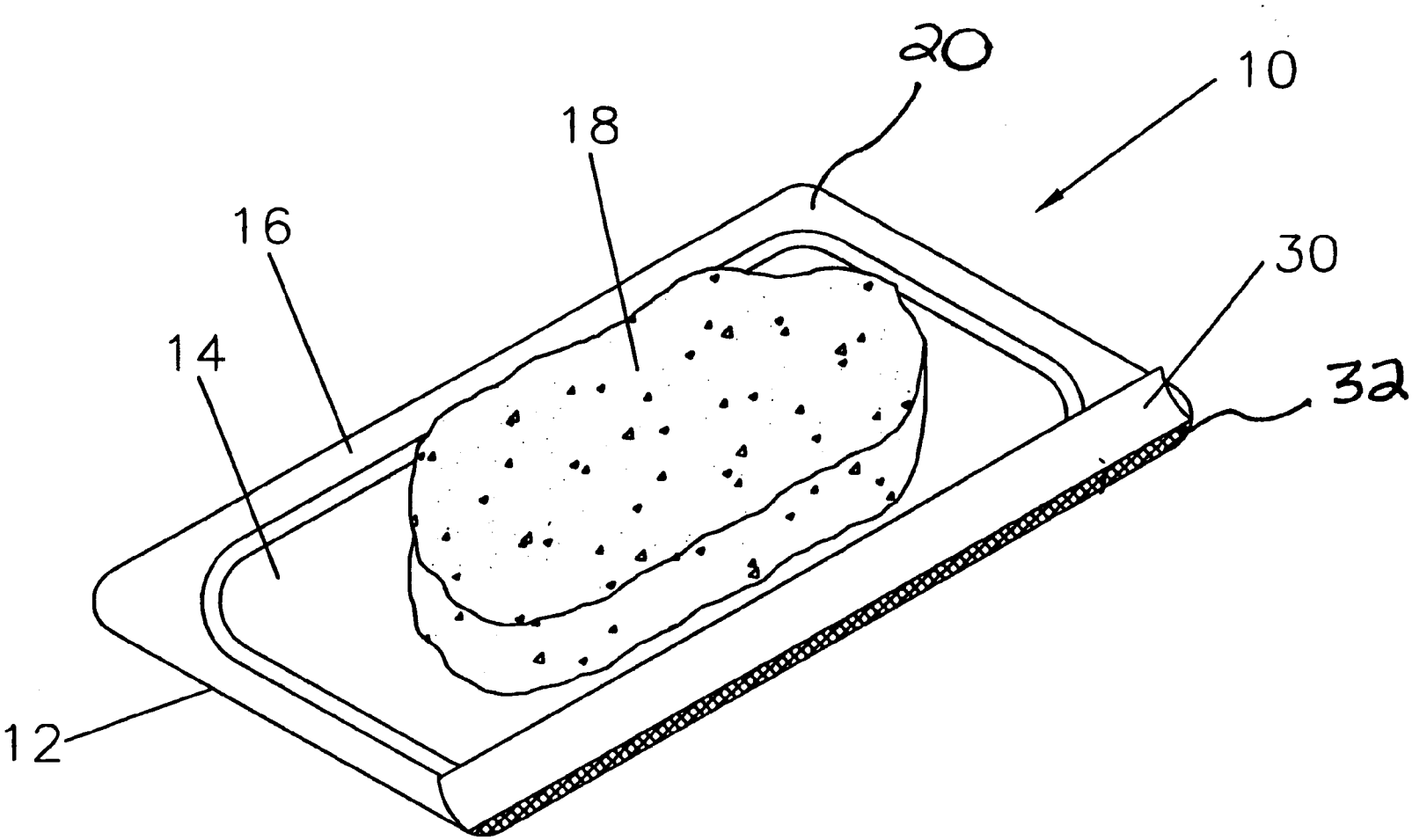
FIG. 1 is a perspective view of one embodiment of a vacuum skin package which can be made in accordance with the present invention.

FIG. 1 illustrates preferred vacuum skin package 10 that comprises gas-impermeable support member 12 on which is positioned product 18. Suitable materials from which support member 12 can be formed include, without limitation, polyvinyl chloride, polyethylene terephthalate, polystyrene, polyolefins such as high density polyethylene or polypropylene, paper pulp, nylon, polyurethane, etc. The support member may be foamed or non-foamed as desired, and preferably provides a barrier to the passage of oxygen therethrough, particularly when product 18 is an oxygen-sensitive food product. When such oxygen-sensitive products are to be packaged in a low-oxygen environment (to thereby extend their shelf-life), support member 12 preferably allows less than or equal to about 1000 cc of oxygen to pass, more preferably less than about 500 cc of oxygen, more preferably still less than about 100 cc, even more preferably less than about 50 cc, and most preferably less than about 25 cc of oxygen to pass per square meter of material per 24 hour period at 1 atmosphere and at a temperature of 73° F. (at 0% relative humidity). Support member 12 may be formed from a material which itself provides a barrier to the passage of oxygen, e.g., vinylidene chloride copolymer, nylon, polyethylene terephthalate, ethylene/vinyl alcohol copolymer, etc. Alternatively, support member 12 may have a substantially gas-impermeable sealant film laminated or otherwise bonded to the inner or outer surface thereof. For example, support member 12 may comprise a polyvinyl chloride (PVC) substrate coated with a gas barrier material and a heat sealing material. It is preferred that the support member comprises an at least semi-flexible material or composite which is supplied in roll or sheet form and which may be cut and, preferably, formed in-line during the process of making the package. Heat sealing materials useful with support member 12 include branched-chain low density polyethylene (LDPE), ionomers such as Surlyn™ available from DuPont, ethylene/methacrylic acid copolymers such as Nucrel™ available from DuPont, ethylene/acrylic acid copolymers such as Primacor™ available from Dow, and EVA copolymers, to name but a few. Support member 12 may be flat or it may be formed in the shape of a tray. As shown in FIG. 1, support member 12 is a tray which includes a downwardly formed cavity 14 and an upper flange 16. Product 18 is contained within downwardly formed cavity 14.

Product 18 is typically a food product such as fresh red meat. Retail cuts of beef, pork, veal and lamb are preferred food products for use with the package of the invention. When such food products are vacuum skin packaged or packed in the absence of oxygen, the fresh red meat will tend to turn a purplish color and remain that way as long as it is chilled and kept out of contact with oxygen. The bright red bloom is restored when the meat makes contact with oxygen again.

Referring now collectively to FIGS. 1–4, thermoformable composite film 20 covers product 18 and is sealed around the perimeter of product 18, thereby assuming the shape of the product and thus becoming a "skin." Composite film 20 is preferably coextruded and comprises gas-impermeable component film 24 peelably adhered to gas-permeable component film 22.

Generally, composite film 20 may comprise any number of layers equal to or greater than two. The gas-permeable component film is preferably sealable to a support member in accordance with the present invention and the gas-impermeable component film is preferably sealable to a grippable film in accordance with the present invention. Any composite film which provides these basic features, regardless of the number of layers it contains, may be employed in the present invention. For example, for the gas-permeable film, it is possible that a single layer may be provided which may be appropriately bonded to the gas-impermeable film, is sealable to a support member such that the peel force between the gas-permeable film and the support member is greater than that between the gas-permeable film and the gas-impermeable film, provides the desired level of gas permeability, and is capable of protecting the underlying product following removal of the gas-impermeable film. For the gas-impermeable film it is less likely, but still feasible, that a single layer may be provided which may be appropriately bonded to the gas-permeable film, is sealable to a grippable film such that the peel force between the grippable film and the gas-impermeable film is greater than that between the gas-impermeable film and the gas-permeable film, provides the desired level of gas impermeability, and is sufficiently abuse resistant to protect the underlying product during the distribution process. It is more likely that the gas-permeable film includes at least a sealing layer capable of sealing the gas-permeable film to the support member and a bonding layer peelably bonded to the gas-impermeable film, and that the gas-impermeable film includes at least a bonding layer peelably bonded to the gas-permeable film, a barrier layer, and an outer abuse layer capable of sealing to the grippable film.

Generally, an acceptable peel force between gas-permeable film 22 and gas-impermeable film 24 ranges from about 0.02–0.05 lbs. A more preferred peel force between the two films ranges from about 0.025–0.04 lbs. A peel force falling within these ranges has been found to provide an optimum balance between: 1) sufficient adhesion to prevent premature film separation, e.g., during shipping and storage, and 2) sufficient peelability that the two films can be separated without tearing or otherwise compromising gas-permeable film 22. A peel force of more than about 0.05 lbs can result in an unacceptably high incidence of damage to gas-permeable film 22 when gas-impermeable film 24 is peeled therefrom. On the other hand, a peel force of less than about 0.02 lbs indicates that an insufficient amount of adhesion may exist between films 22 and 24 so that the likelihood of premature separation (and, therefore, spoilage of product 18) is unacceptably high.

For purposes of the present invention, any combination of polymeric materials or blends which yield a peel force between the two films within the desired range may be employed in the bonding layers. The following combinations have been found to provide acceptable peel forces.

One type of peelable composite film may employ waxes in one or both of the intermediate bonding layers to facilitate peelable separation between the gas-permeable and gas-impermeable component films.

In another type of composite film, the bonding layer of film 24 comprises EVOH and the bonding layer of film 22 comprises polyethylene or an ethylene/alpha-olefin copolymer having a density in the range of greater than about 0.94 g/cc to about 0.96 g/cc. An example of a suitable material for the bonding layer of film 22 is HDPE.

In yet another type of composite film, the bonding layer of gas-impermeable film 24 comprises EVOH and the bonding layer of film 22 comprises EPC. A preferred EPC comprises about 2 to about 6 percent by weight ethylene copolymer and about 94 to about 98 percent by weight propylene copolymer. EPC is the preferred material for the bonding layer of film 22 because it has been found to provide a combination of beneficial physical properties, including mechanical strength (toughness), optical clarity, and an adequately high oxygen transmission rate of around 6200 cc/$m^2$-day-atmosphere per mil of thickness. In addition, the adhesion between EPC and EVOH is relatively low. Thus, no slip agents, such as a migratable wax additive, is needed to provide good peelability between the two bonding layers.

A preferred layer-by-layer structure for composite film 20 is

Layers: EAO/EBA/EPC//EVOH/EVA/EVOH/EVA/Ionomer/HDPE, wherein "//" represents the peelable interface between the gas-permeable and gas-impermeable film components and "EAO" represents a narrow molecular weight distribution ethylene/alpha-olefin copolymer. Film 20 preferably has a thickness in the range of from about 2.0 to about 6.0 mils, wherein gas-permeable component film 22 has a thickness in the range of 1.0 to 3.0 mils and gas-impermeable component film 24 has a thickness in the range of 1.0 to 5.0 mils.

Permeable film 22 preferably exhibits good oxygen permeability for satisfactory bloom of product 18 upon removal of gas-impermeable film 24. A preferred oxygen transmission rate (OTR) for gas-permeable film 22 is at least 7500 cc/$m^2$-day-atmosphere (dry basis). Such an OTR has been found to impart a desirably rapid bloom and an aesthetically pleasing color of red to product 18. It should be understood, however, that gas-permeable films having a lower OTR are still within the scope of the present invention. That is, while such lower OTR films may not provide as rapid a bloom or result in as desired a color as films with an OTR of at least 7500 cc/$m^2$-day-atmosphere, such films are nevertheless operable and, in some instances, may be desirable.

Film 20 can be made by a coextrusion process as described in U.S. Pat. No. 4,287,151. Suitable annular or flat sheet multilayer coextrusion dies for coextruding the films of the invention are well known in the art.

Composite film 20 is preferably crosslinked. The preferred method of crosslinking is by electron-beam irradiation and is well known in the art. One skilled in the art can readily determine the radiation exposure level suitable for a particular application.

Figure 2:
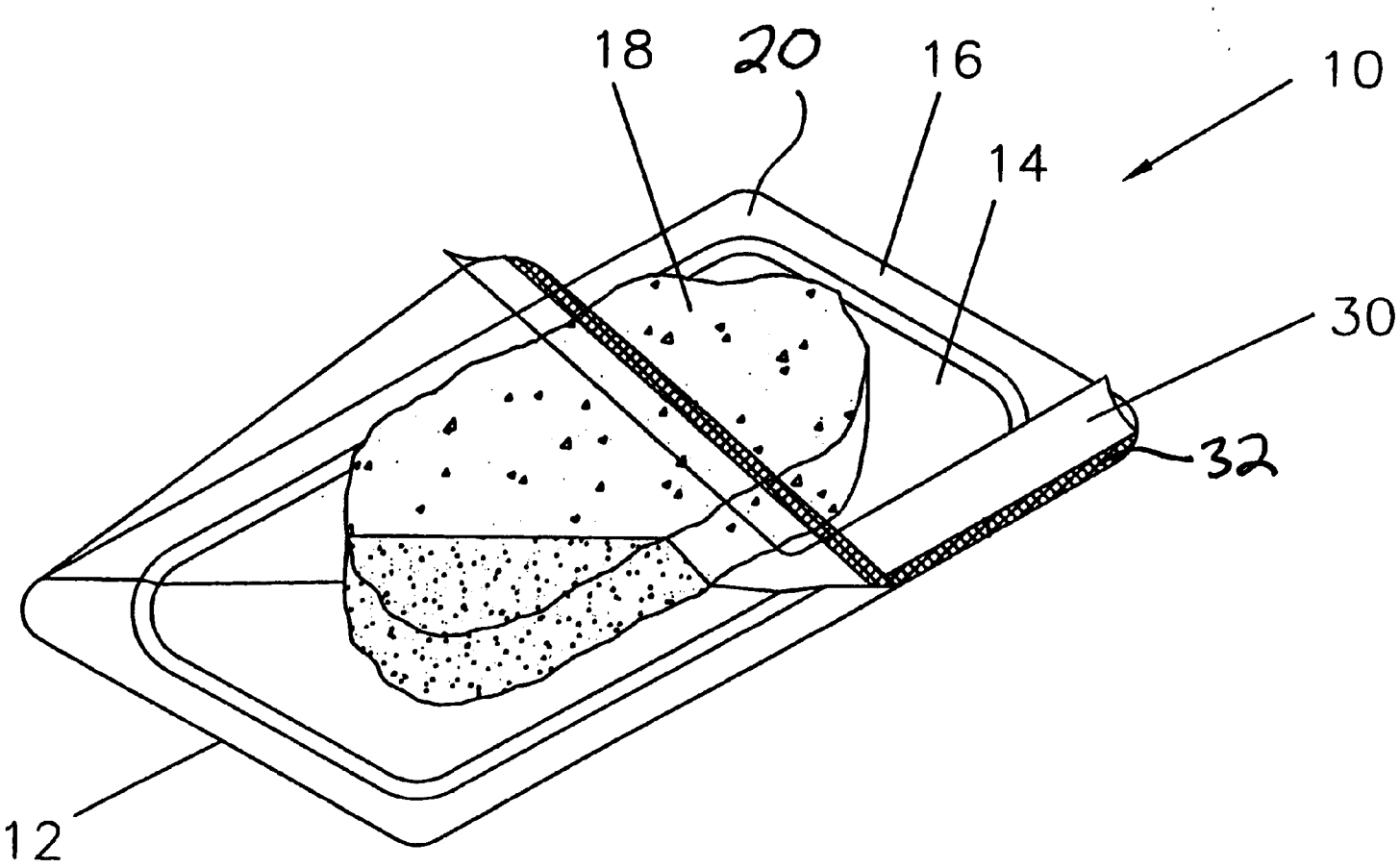
FIG. 2 illustrates the vacuum skin package of FIG. 1 with the grippable film being pulled, thereby peeling the gas-impermeable film from the gas-permeable film.
Figure 3:
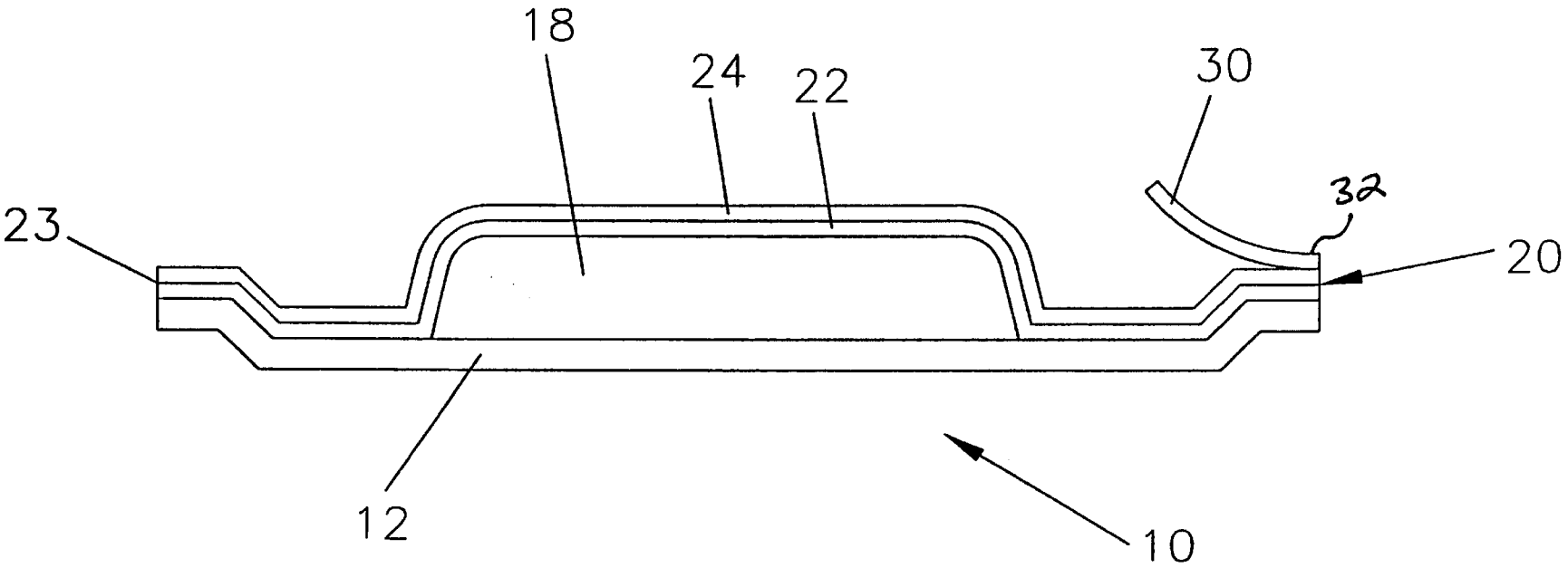
FIG. 3 is a cross-sectional view of the package of FIG. 1.
Figure 4:
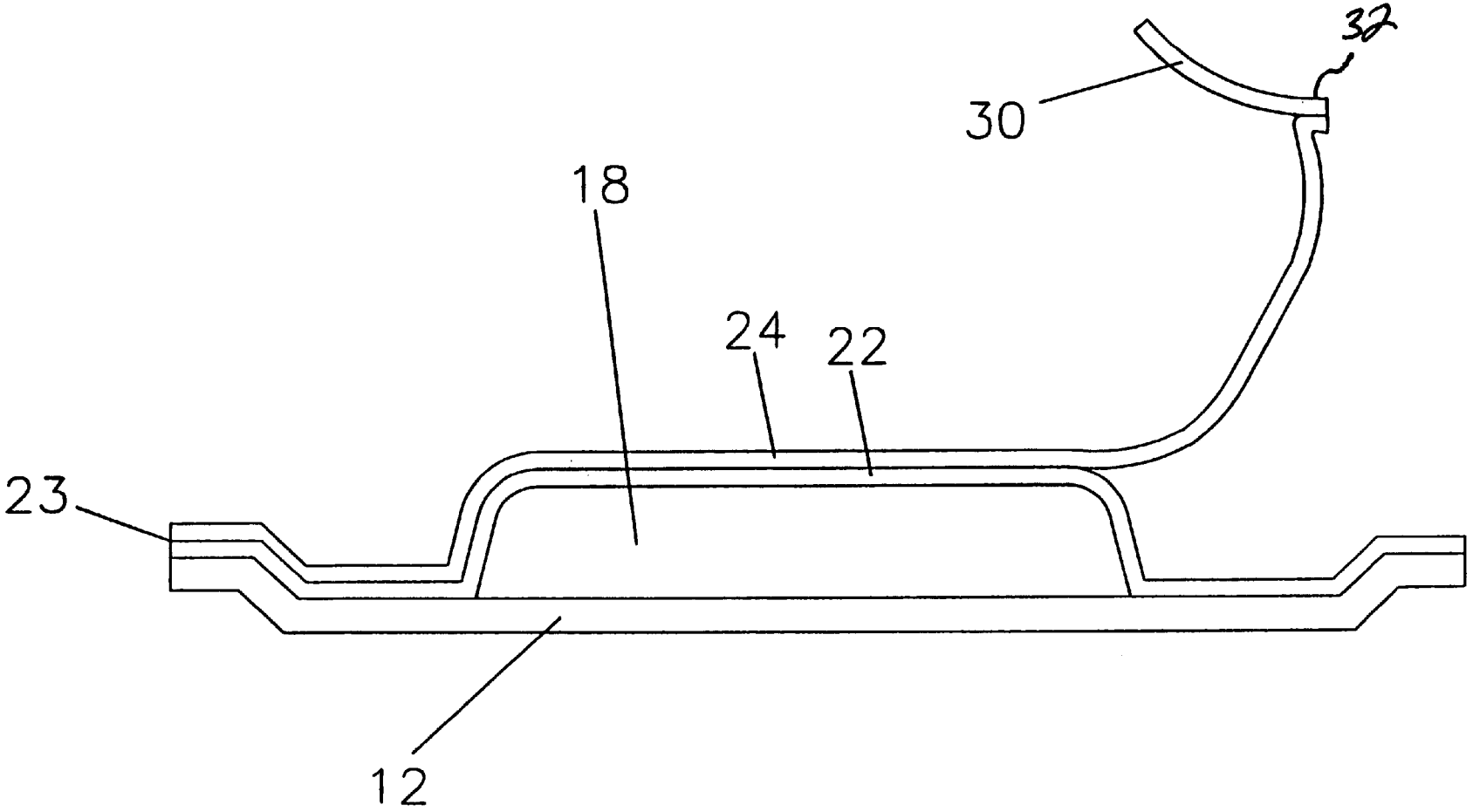
FIG. 4 is a cross-sectional view of the package of FIG. 1 during the peeling operation as illustrated in FIG. 2.

Turning now to the peel initiation mechanism of the present invention, grippable film 30 is provided across one edge of package 10 as illustrated in FIGS. 1–4. Grippable film 30, as shown in FIGS. 1 and 3, can thus be gripped and pulled to a position as shown in FIGS. 2 and 4 so that film 20 delaminates at interface 23 rather than at its bond with support member 12. This leaves gas-permeable film 22 firmly adhered to support member 12 and enclosing product 18 because the material of the sealing layer of film 22 is selected so as to form a bond to support member 12 that is stronger than the internal cohesive strength of composite film 20. That is, film 22 separates from film 24 at interface 23 while maintaining its seal to support member 12, the bond strength between film 22 and support member 12 being greater than the weak bond at interface 23 between film 24 and film 22. In this manner film 24 can be completely separated from package 10 while leaving film 22 intact and sealed thereto to encase product 18 and allow the product, for example a fresh red meat, to regain its bright red bloom and be suitable for display in a showcase or retail display. In order to initiate the separation of film 24 from film 22, the bond strength between film 24 and grippable film 30 must exceed the strength of the bond between film 24 and film 22 at interface 23. Otherwise, any pulling force on the grippable film would peel the grippable film from film 24 rather than initiating the peeling of film 24 from film 22.

As is shown in FIGS. 1–4, it is preferred that the sealed area 32 of grippable film 30 extends along an edge of the package and, specifically, at an edge of the gas-impermeable film. It is also preferred that the sealed area 32 is cut simultaneously with the composite film and the support member, as is discussed in greater detail below. It is also preferred that the sealed area 32 which remains after cutting is as narrow as possible. Preferably, the sealed area 32 is no wider than about five millimeters (mm), more preferably no wider than about four mm, more preferably still no wider than about three mm, and yet more preferably no wider than about two mm. The grippable portion 30 which extends from the sealed portion 32 must be of sufficient width to be readily gripped for peeling. Generally, there is no outer limit to the width of the grippable portion with respect to operability of the mechanism. But, as can be seen from a review of FIG. 5, discussed below, the rolls of grippable film which are extended above the formed packages should not be so wide as to preclude adjacent positioning.

In the method of the invention utilizing the components described above, after positioning product 18 on support member 12, composite film 20 is positioned over product 18 and support member 12, heated and a partial vacuum is drawn between film 20 and support member 12. In this manner, film 20 is closely formed to both product 18 and to support member 12. Grippable film 30 is sealed to the upper surface of composite film 20 and the package is cut through both the seal 32 of grippable film 30 to composite film 20 and the seal of composite film 20 to support member 12. Package 10 can be stored or preserved in this configuration until it is desired to display package 10 for retail sale, at which time grippable film 30 is pulled thereby initiating peeling of gas-impermeable film 24 from gas-permeable film 22. Although it is generally preferred that grippable film 30 is continuously sealed to gas-impermeable film 24 along the length of the package, in an alternative embodiment the seal may be intermittent such that the user may extend his fingers through the nonsealed portions, thereby achieving a more secure grip for peel initiation.

Figure 5:
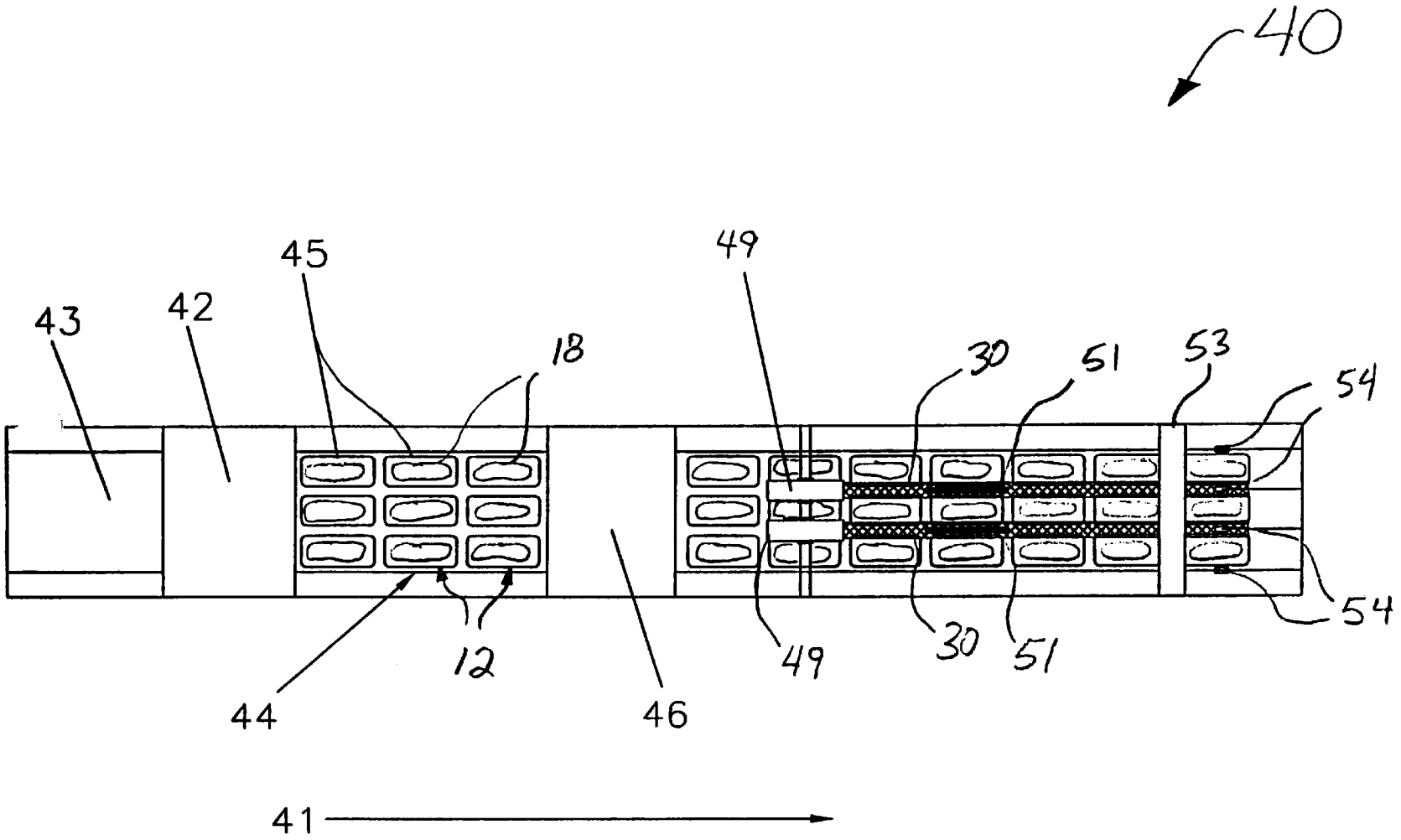
FIG. 5 is a schematic plan view of packaging line employed in the process of the present invention.
Figure 6:
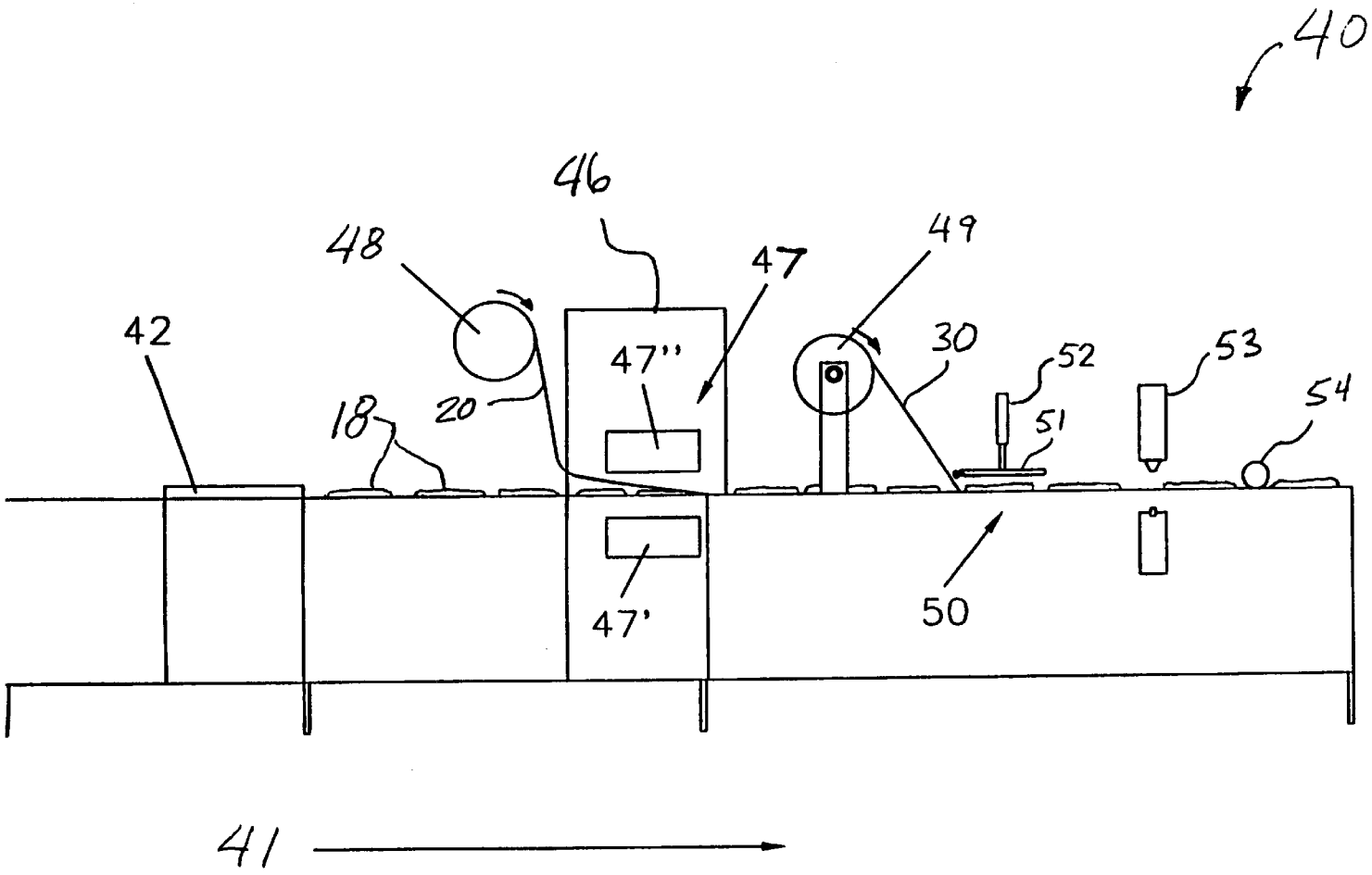
FIG. 6 is a schematic side view of the packaging line of FIG. 5.
Figure 7:
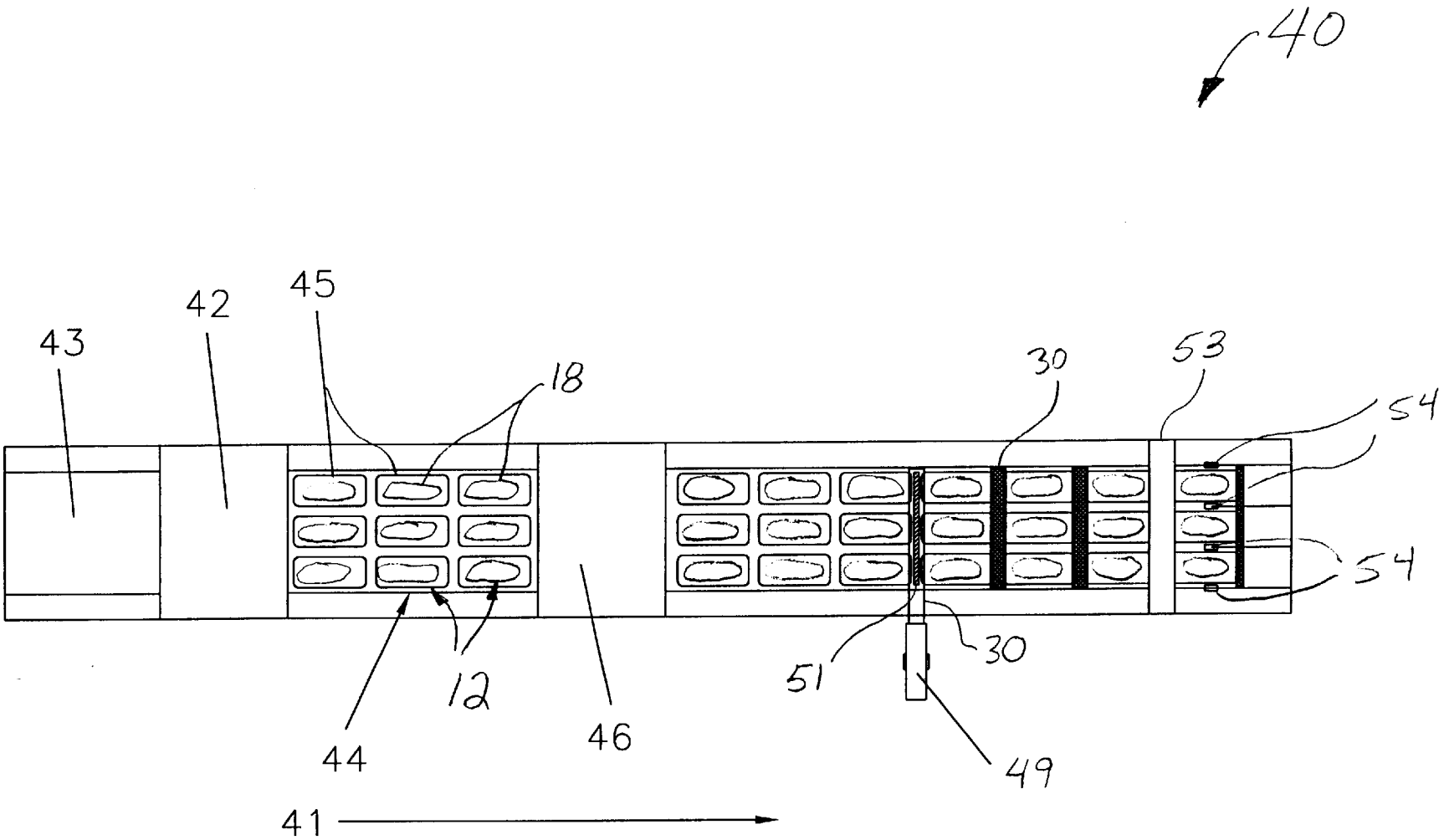
FIG. 7 is a schematic plan view of a packaging line employed in an alternative embodiment of the process of the present invention.

The method of the present invention is more clearly illustrated in the figures of the drawing at FIG. 5–FIG. 7. Looking first to FIG. 5, a machine assembly 40 which may be employed in the production of packages in accordance with the present invention is shown in a schematic plan view wherein the machine direction, i.e., the direction in which the packages are made, extends from left to right as represented by arrow 41. Preferably, preform station 42 thermoforms sheet or web 43 (from a source not shown, e.g., a storage roll) into a plurality of support members 12, each of which has a product-support area 45 in the form of a downwardly extending cavity. Each of the support members is later severed from the web 43 as individual packages. As noted above, non-formed, substantially planar support members (i.e., without downwardly extending cavities) are also within the scope of the present invention. At the loading area 44, the cavities 45 of support members 12 (or product receiving areas of non-formed support members) are filled with product 18 (from a source not shown). At vacuum skin packaging station 46, composite film 20 is unwound from roll 48 (not shown in FIG. 5 for clarity) and extended over the underlying support members 12, loaded with product 18, and then heated to a temperature sufficient to soften, but not melt, the composite film. Also in vacuum skin packaging station 46, vacuum chamber 47, which includes lower vacuum chamber 47' and upper vacuum chamber 47", is closed and the area between composite film 20 and the underlying product and support member is evacuated. Thereafter, the uncut vacuum skin packages are indexed in the direction of arrow 41 to station 50 for the application of the grippable film 30. As is best understood from a review of both FIGS. 5 and 6, a pair of strips of grippable film 30 are unwound from rolls 49 and extended over the uncut vacuum skin packages, intermediate to the product-support areas 45 and above the areas wherein film 20 is sealed to support members 12. As shown, the grippable film 30 extends longitudinally, i.e. in the machine direction 41, from rolls 49. The strips of film 30 are then heat-sealed to the upper surface of composite film 20 intermediate the product support areas 45 via heat-seal bars 51 which are pressed into contact with the upper surface of films 30 by actuating cylinders 52 (only one shown).

The web then advances to transverse knife 53, which severs individual rows of packages from the remainder of the web, and then to longitudinal knives 54 which longitudinally sever each of the packages from the previously separated row of packages, thereby producing individual packages. The cuts made by knives 53 and 54 extend completely grippable film 30, composite film 20, and bottom web 43. The longitudinal cuts formed by knives 54 extending along and through the sealed area between the grippable film 30 and the composite film 20 such that a portion of the seal is positioned at the edge of each of the packages, as discussed above. That is, each of the strips of grippable film 30 is cut approximately in half and through the seal between the films 30 and the composite film 20 in the machine direction 41 so that each of the resultant packages on each side of the cut has a portion of the strip of grippable film 30 extending from a portion (half) of the original heat-seal at the edge of the package as shown in FIGS. 1–4.

In an alternative embodiment as illustrated in FIG. 7, the grippable film 30 is extended from roll 49 in the transverse direction and sealed to the underlying uncut packages intermediate the product-support areas 45 via transversely-oriented heat-seal bar 51. Transverse knife 53 then makes transverse cuts through the grippable film 30, composite film 20, and bottom web 43 to make separate rows of packages while longitudinal knives 54 similarly make longitudinal cuts to finally separate individual packages from one another. The transverse cut by knife 53 is preferably made through the seal between the grippable film and the composite film so that each package on either side of the cut has a grippable film extending from a heat-seal at the edge of the package. It should also be noted that, instead of having three packages in each row as shown, a greater number or a lesser number may be included in each row, such as a single column of packages that are made one-at-a-time in machine assembly 40.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A package, comprising:

a support web;

a product supported on the support web;

a composite film enclosing the product, the composite film comprising:

a gas-permeable component film having an upper surface and a lower surface, the lower surface of the gas-permeable film sealed to the support web; and a gas-impermeable component film having an upper surface and a lower surface, the lower surface of the gas-impermeable film bonded to the upper surface of the gas-permeable film, wherein the bond strength between the gas-impermeable film and the gas-permeable film is less than the bond strength between the gas-permeable film and the support web; and a peel initiation mechanism comprising a grippable film sealed to the upper surface of the gas-impermeable film forming a sealed area at and along an edge of the gas-impermeable film, a nonsealed portion of the grippable film extending from the sealed area, wherein the bond strength between the grippable film and the gas-impermeable film is greater than the bond strength between the gas-impermeable film and the gas-permeable film.

2. The package set forth in claim 1 comprising a vacuum skin package wherein the composite film is formed on the product.

3. The package set forth in claim 1 wherein the support web comprises a downwardly formed cavity containing the product and an upper, peripheral flange.

4. The package set forth in claim 1 wherein the seal between the grippable film and the gas-impermeable film is continuous.

5. The package set forth in claim 1 wherein the seal between the grippable film and the gas-impermeable film is intermittent.

6. A package, comprising:

a support member;

a composite film in adherence with said support member such that an enclosure suitable for containment of a product is formed, said composite film comprising a gas-permeable component film and a gas-impermeable component film which is peelably removable from said gas-permeable film, said gas-permeable film positioned between said gas-impermeable film and said support member and comprising a bonding layer that is peelably adhered to said gas-impermeable film; and a grippable film bonded to an upper surface of said gas-impermeable film via a seal along an edge of said gas-impermeable film, said grippable film having a grippable portion extending outwardly from the seal;

wherein the bond strength between the gas-permeable film and the gas-impermeable film is less than seal strength between the grippable film and the gas-impermeable film, such that the gas-impermeable film may be peeled from the gas-permeable film by pulling the grippable film.

7. The package set forth in claim 6 comprising a vacuum skin package wherein the composite film is formed on the product.

8. The package set forth in claim 6 wherein the support web comprises a downwardly formed cavity containing the product and an upper, peripheral flange.

* * * * *